US010898054B2

(12) United States Patent
Yang et al.

(10) Patent No.: US 10,898,054 B2
(45) **Date of Patent: *Jan. 26, 2021**

(54) DISHWASHER

(71) Applicant: LG Electronics Inc., Seoul (KR)

(72) Inventors: Daebong Yang, Seoul (KR); Minseong Kim, Seoul (KR); Hyungman Park, Seoul (KR)

(73) Assignee: LG Electronics Inc., Seoul (KR)

( * ) Notice: Subject to any disclaimer, the term of this patent is extended or adjusted under 35 U.S.C. 154(b) by 215 days.

This patent is subject to a terminal disclaimer.

(21) Appl. No.: 16/118,729

(22) Filed: Aug. 31, 2018

(65) Prior Publication Data

US 2019/0059689 A1 Feb. 28, 2019

(30) Foreign Application Priority Data

Aug. 31, 2017 (KR) ..... 10-2017-0111510

(51) Int. Cl.

| | |
|---|---|
| ***A47L 15/00*** | (2006.01) |
| ***A47L 15/42*** | (2006.01) |
| ***A47L 15/08*** | (2006.01) |
| ***F04D 13/16*** | (2006.01) |
| ***F04D 29/58*** | (2006.01) |
| ***F04D 29/42*** | (2006.01) |
| ***F04D 13/08*** | (2006.01) |

(52) U.S. Cl.

CPC ..... *A47L 15/4234* (2013.01); *A47L 15/0015* (2013.01); *A47L 15/08* (2013.01); *A47L 15/428* (2013.01); *F04D 13/08* (2013.01); *F04D 13/16* (2013.01); *F04D 29/4293* (2013.01); *F04D 29/586* (2013.01); *A47L 2601/04* (2013.01)

(58) Field of Classification Search

CPC ..... A47L 15/4234

See application file for complete search history.

(56) References Cited

U.S. PATENT DOCUMENTS

| | | | | |
|---|---|---|---|---|
| 4,135,531 | A | 1/1979 | Federighi et al. | |
| 2009/0205681 | A1 | 8/2009 | Choi et al. | |
| 2014/0182625 | A1* | 7/2014 | Lee | A47L 15/4221 134/18 |
| 2015/0359411 | A1* | 12/2015 | Kim | A47L 15/4285 134/18 |
| 2016/0051120 | A1 | 2/2016 | Lee et al. | |

* cited by examiner

*Primary Examiner* — Jason Y Ko

(74) *Attorney, Agent, or Firm* — Fish & Richardson P.C.

(57) ABSTRACT

Disclosed is a dishwasher that sprays washing water and steam to wash dishes or cooking appliances. The dishwasher according to the present invention includes: a tub which receives a target of washing; a sump which is disposed at a bottom of the tub to store washing water; a spray arm which sprays the washing water stored in the sump into the tub; a heater which generates heat by heating washing water in a circulation passage connecting the sump and the spray arm; and a steam passage which is connected to the steam nozzle, and in which the steam generated by the heater flows. Accordingly, the steam generated in the circulation passage may be supplied smoothly.

19 Claims, 11 Drawing Sheets

DISHWASHER

CROSS-REFERENCE TO RELATED APPLICATION

This application claims the priority benefit of Korean Patent Application No. 10-2017-0111510, filed on Aug. 31, 2017, in the Korean Intellectual Property Office, the disclosure of which is incorporated herein by reference.

FIELD

The present invention relates to a dishwasher including the same and, more particularly, to a dishwasher that sprays washing water and steam to wash dishes and cooking appliances.

BACKGROUND

A dishwasher is a home appliance for washing foreign substance such as food waste remaining in a dish, a cooking appliance, and the like (hereinafter, referred to as a "target of washing") by high-pressure washing water sprayed from a spray arm.

The dishwasher generally consists of a tub forming a washing space, and a sump mounted to the bottom of the tub. In addition, the washing water moves to the spray arm by a pumping operation of the washing pump mounted in the sump. The washing water having moved to the spray arm is sprayed with high pressure through a spray hole formed in the spray arm. Then, the washing water sprayed with high pressure hits the surface of a target of washing to remove foreign substance remaining in the target of washing.

Meanwhile, the dishwasher may generate steam and supply the generated steam to a tub so as to heat or sterilize a target of washing. Thus, the generated steam needs to be supplied into the tub uniformly.

SUMMARY

One object of the present invention is to provide a dishwasher that discharges generated steam into a tub uniformly.

Another object of the present invention is not limited to the aforementioned objects, and those skilled in the art will clearly understand non-mentioned other objects through the following description.

In one general aspect of the present invention, the above and other objects can be accomplished by the provision of a dishwasher including: a tub which forms a washing space where a target of washing is received; a sump which is disposed under the tub to store washing water; a spray arm which sprays the washing water stored in the sump into the tub; a heater which generates heat by heating washing water in a circulation passage connecting the sump and the spray arm; a steam nozzle which discharges the steam, generated by the heater, into the tub; and a steam passage which is connected to the steam nozzle, and in which the steam generated by the heater flows, wherein at least one of the spray arm and the sump discharges the steam, generated by the heater and then flowing through the circulation passage, into the tub.

The steam passage may be branched from the circulation passage.

A part of the steam passage may be disposed under a bottom of the tub and connected to the steam nozzle.

The dishwasher may further include a door which is provided at a front surface of the tub to open and close the washing space, and the steam nozzle may be provided at a lower end of the door and discharges steam in an upwardly inclined manner.

A part of the steam passage may be disposed toward the door along an edge of one lateral side of a top of the sump.

A part of the steam passage may be disposed toward the door along an edge of one lateral side of the bottom of the tub.

A part of the steam passage may be disposed to be inclined upwardly toward the door from an edge of one lateral side of the bottom of the tub.

A part of the steam passage may be disposed to be inclined upwardly toward a top of the sump in the circulation passage.

The heater may generate steam under the bottom of the tub.

The steam passage may be connected to the circulation passage under a bottom of the tub.

The dishwasher may further include a washing pump which is disposed in the circulation passage to pump the washing water stored in the sump to the spray arm, and the steam passage may be connected to the washing pump.

A part of the heater may be disposed inside the washing pump.

The washing pump may include: a rotatable impeller which causes the washing water to flow; a pump upper portion in which the impeller is received such that the washing water flows out to the spray arm; and a pump lower portion into which the washing water stored in the sump flows, and the steam passage may be connected to the pump upper portion.

The spray arm may be provided as a plurality of spray arms, the dishwasher may further include: a rotatable impeller disposed in the circulation passage to pump the washing washer; and a switch valve selectively connecting the sump to at least one of the plurality of spray arms, and the steam passage may be connected between the impeller and the switch valve in the circulation passage.

The switch valve may connect the sump to a spray arm disposed highest among the plurality of spray arms when the heater generates steam, and the spray arm disposed highest among the plurality of spray arms may discharge the steam downward from a top of the tub.

The dishwasher may further include a filter which is disposed inside the sump to filter out foreign substances, the steam discharged from the sump through the circulation passage may pass through the filter.

The sump may discharge steam upwardly from a bottom of the tub.

The dishwasher including the same according to the present invention provide at least the following effects.

First, since the steam passage is branched from the circulation passage in which washing water flows, it is possible to generate steam using a small amount of washing water with less energy.

Second, since the steam passage is branched from the circulation passage, steam may flow through the circulation passage to be discharged into the tub through a spray arm and/or a sump.

Third, steam may be discharged into the tub in various directions and therefore the steam may uniformly act on a target of washing.

Fourth, steam may sterilize the filter.

It should be understood that advantageous effects according to the present invention are not limited to the effects set forth above and other advantageous effects of the present invention will be apparent from the detailed description of the present invention.

BRIEF DESCRIPTION OF THE DRAWINGS

The embodiments will be described in detail with reference to the following drawings in which like reference numerals refer to like elements wherein.

DETAILED DESCRIPTION

Figure 1:
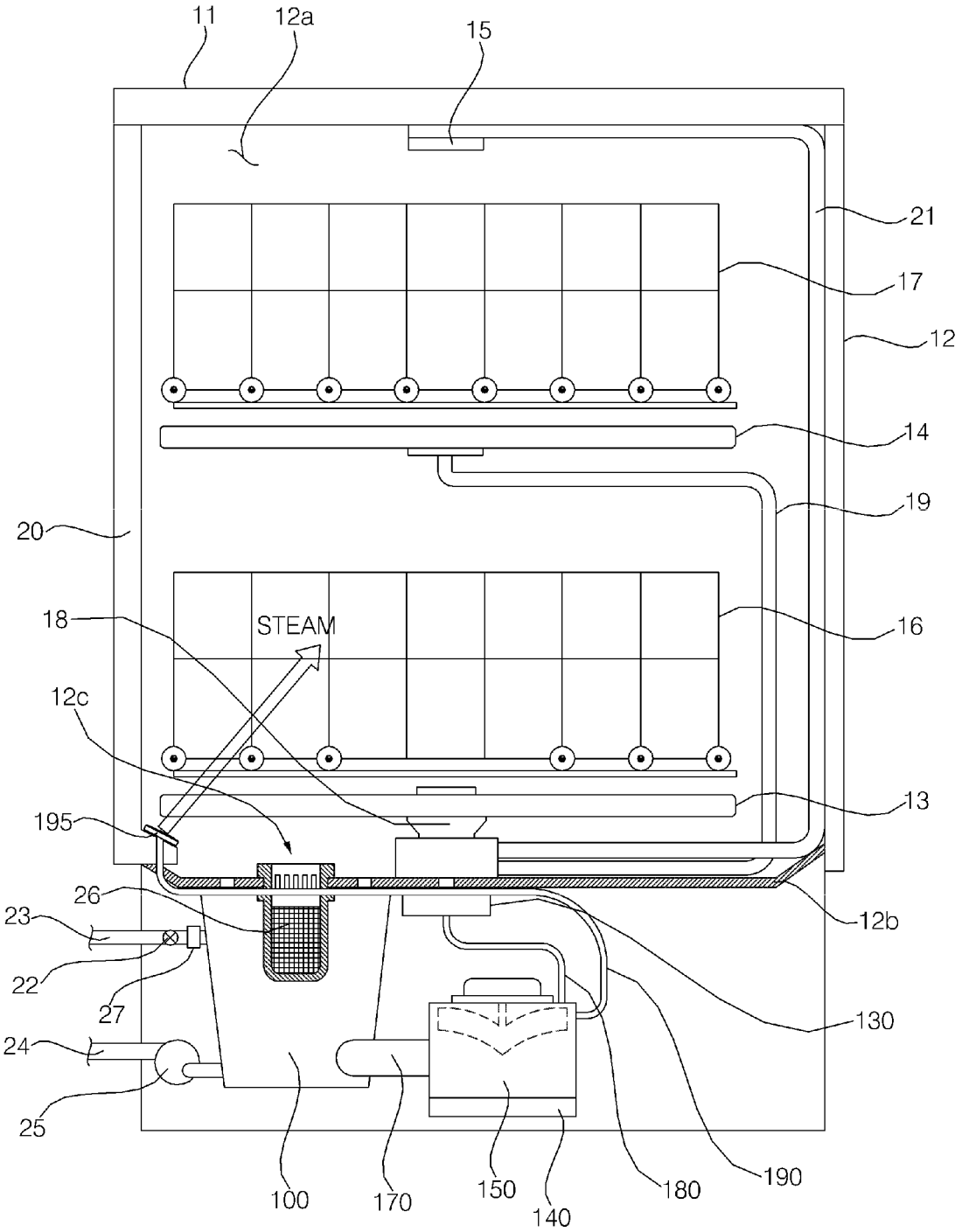
FIG. 1 is a schematic diagram illustrating a structure of a dishwasher according to an embodiment of the present invention.

Advantages and features and methods for achieving those of the present disclosure may become apparent upon referring to embodiments described later in detail with reference to the attached drawings. However, embodiments are not limited to the embodiments disclosed hereinafter and may be embodied in different ways. The embodiments are provided for perfection of disclosure and for informing persons skilled in this field of art of the scope. The same reference numerals may refer to the same elements throughout the specification.

Hereinafter, a dishwasher according to embodiments of the present invention will be described with the accompanying drawings.

Figure 2:
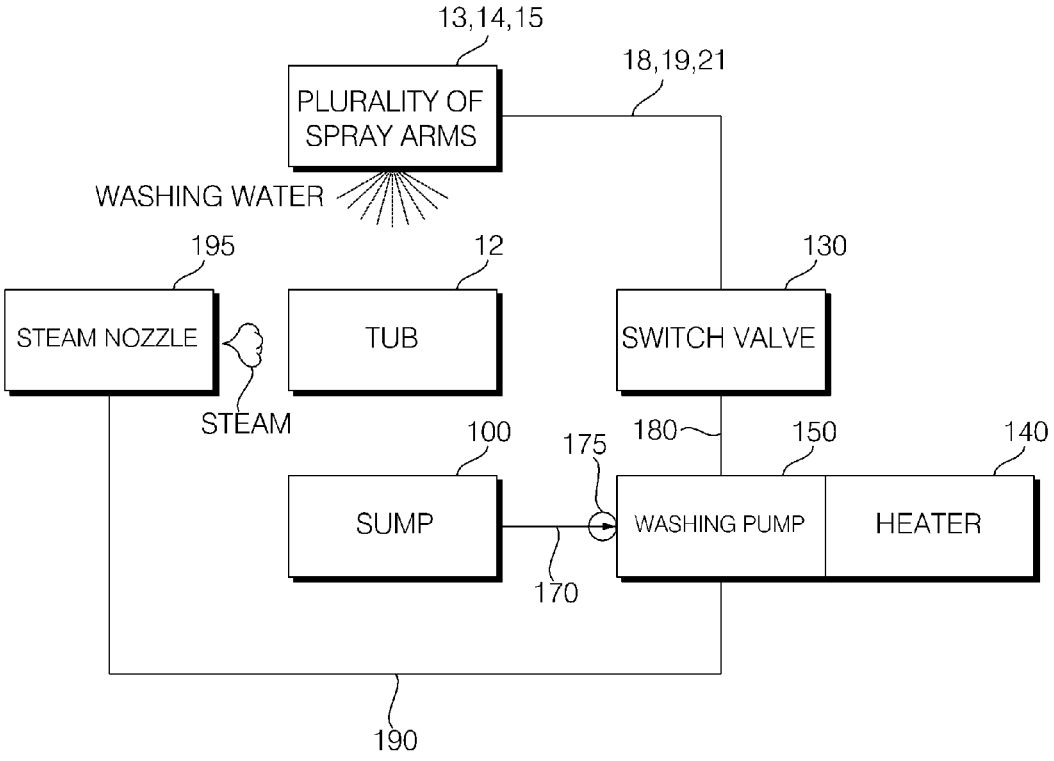
FIG. 2 is a diagram illustrating a configuration of a dishwasher according to an embodiment of the present invention.

FIG. 1 is a schematic diagram illustrating a structure of a dishwasher according to an embodiment of the present invention, and FIG. 2 is a diagram illustrating a configuration of a dishwasher according to an embodiment of the present invention.

A dishwasher 1 according to an embodiment of the present invention includes: a case 11 which forms an exterior of the dishwasher 1; a tub 12 which is provided inside the case 11 and forms a washing space 12*a* where a target of washing is received; a door 20 which is provided on a front surface of the tub 12 and used to open/close the washing space 12*a*; a sump 100 which is provided under the tub 12 and stores washing water; a plurality of spray arms 13, 14, and 15 which spray washing water into the tub 12; a washing pump 150 which pumps washing water stored in the sump 100 to the plurality of spray arms 13, 14, and 15; a heater 140 which is disposed in a circulation passage, connecting the sump 100 and at least one of the plurality of spray arms 13, 14, and 15, to heat washing water; and a steam hose 190 in which the steam generated by the heater 140 flows.

The tub 11 is in a hexagonal shape having an open front surface, and includes the washing space 12*a* formed therein. At a bottom 12*b* of the tub 11, a communication unit 12*c* through which washing water flows into the sump 100. A plurality of racks 16 and 17 where targets of washing are received is provided in the washing space 12*a*. The plurality of racks 16 and 17 includes a lower rack 16 disposed in a lower portion of the washing space 12*a*, and an upper rack 17 disposed in an upper portion of the washing space 12*a*. The lower rack 16 and the upper rack 17 may be spaced apart from each other, and may slide out in a forward direction from the tub 11 to be withdrawn.

The plurality of spray arms 13, 14, and 15 are disposed in an upward-downward direction. The plurality of spray arms 13, 14, and 15 includes: a lower spray arm 13 disposed lowest among the spray arms 13, 14, and 15 to spray washing water in an upward direction toward the lower rack 16; an upper spray arm 14 disposed over the lower spray arm 13 to spray washing water in an upward direction toward the upper rack 17; and a top spray arm 15 disposed at a top of the washing space 12*a*, which is positioned over the upper spray arm 14, to spray washing water in a downward direction.

The plurality of spray arms 13, 14, and 15 is supplied with washing water from the washing pump 150 through a plurality of spray arm connection passages 18, 19, and 21. The plurality of spray arm connection passages 18, 19, and 21 includes a low spray arm connection passage 18 connected to the lower spray arm 13, an upper spray arm connection passage 19 connected to the upper spray arm 14, and a top spray arm connection passage 21 connected to the top spray arm 15.

The sump 100 is disposed under the bottom 12*b* of the tub 12 and collects washing water. The sump 100 is connected to a water supply passage 23 in which washing water supplied from an external water source flows. A water supply valve 22 for controlling washing water supplied from the external water source is provided in the water supply passage 23. When the water supply valve 22 is opened, the washing water supplied from the external water source flows into the sump 100 through the water supply passage 23. The water supply passage 23 includes a flow meter 27 for measuring an amount of washing water flowing into the sump 100 through the water supply passage 23.

The sump 100 is connected to a drain passage 24 through which stored washing water is guided to an outside of the dish waster. A drain pump 25 for draining washing water from the sump 100 through the drain passage 24 is provided in the drain passage 24. When the drain pump 25 is driven, washing water collected in the sump 100 flows out of the case 11 through the drain passage 24.

A filter 26 is mounted at a communication hole 12*c*, and filters out foreign substances from washing water that flows from the tub 12 to the sump 100.

The washing pump 150 pumps washing water stored in the sump 100 to at least one of the plurality of spray arms 13, 14, and 15. The washing pump 150 is connected to a switch valve 130 and a washing water supply passage 180. When the washing pump 150 is driven, washing water stored in the sump 100 flows into the washing pump 150 through a water collection passage 170 and is then pumped to the switch valve 130 through a washing water supply passage 180. A check valve 175 is provided inside the water collection passage 170 or between the water collection passage 170 and the washing pump 150.

The washing pump 150 is installed on one lateral side of the sump 100. The washing pump 150 is connected to a steam passage 190. Steam generated in the washing pump 150 is supplied to a steam nozzle 195 through the stream passage 190.

The heater 140 is disposed in a circulation passage in which washing water flows from the sump 100 to at least one of the plurality of spray arms 13, 14, and 15, and the heater 140 heats the washing water. In this embodiment, a circulation passage includes the water collection passage 170, the washing pump 150, the washing water supply passage 180, the switch valve 130, and at least one of the plurality of spray arms connection passages 18, 19, or 21. It is desirable that the heater 140 is disposed to heat washing water within the washing pump 150 in the circulation passage. It is desirable that the heater 140 is disposed between the sump 100 and the switch valve 130 in the circulation passage. In this embodiment, the heater 140 is coupled to the bottom of the washing bump 150.

The heater 140 generate hot water by heating washing water when the washing water flows in the circulation passage upon activation of the washing pump 150. When the washing pump 150 stops and the washing water does not flow in the circulation passage, the heater 140 generate steam by heating the washing water.

The hot water generated by the heater 140 flows along the circulation passage and is sprayed into the tub 12 through at least one of the plurality of spray arms 13, 14, and 15. The steam generated by the heater 140 flows along the steam passage 190 and is then discharged to the tub 12 through the steam nozzle 195.

The washing pump 150 and the heater 140 will be described with reference to FIGS. 3 to 6.

Steam generated by the heater 140 is discharged through the steam nozzle 195 into the tub 12. The steam nozzle 195 is provided at a lower end of the door 20 such that the steam generated by the heater 140 is discharged to be inclined upwardly. The steam discharged from the steam nozzle 195 acts on a target of washing received in the lower rack 16 and/or the upper rack 17.

In this embodiment, the steam passage 190 is the steam hose 190 that is branched from the circulation passage and then connected to the steam nozzle 195. It is desirable that the steam hose 190 is connected to the washing pump 150 in the circulation passage.

The switch valve 130 is disposed within the circulation passage, and selectively connects the sump 100 to at least one of a plurality of spray arms 13, 14, and 15. The switch valve 130 selectively supplies washing water, pumped by the washing pump 150, to at least one of the low spray arm 13, the upper spray arm 14, or the top spray arm 15. The switch valve 130 selectively connects the washing water supply passage 180 to at least one of the plurality of spray arm connection passage 18, 19, and 21. The switch valve 130 can be disposed in the sump 100.

The check valve 175 is disposed between the sump 100 and the washing pump 150 and is capable of being opened in a direction from the sump 100 to the washing pump 150. The check valve 175 is opened to allow washing water to flow from the sump 100 to the washing pump 150, and the check valve 175 is closed not to allow washing water to flow from the washing pump 150 to the sump 100. A lower portion of the check valve 175 is rotated relative to an upper portion of the check valve 175 such that the check valve 175 is opened. The check valve 175 is disposed inside the water collection passage 170 or connected between the water collection passage 170 and the washing pump 150 so as to open and close the water collection passage 170.

The check valve 175 is closed when the heater 140 generates steam. The check valve 175 is formed with a lower portion thereof which is partially open such that some of steam generated in the washing pump 150 are allowed to flow to the sump 100.

When washing water flows upon operation of the washing pump 150, the check valve 175 is opened. When washing water stops flowing upon deactivation of the washing pump 150, the check valve 175 is closed. The check valve 175 is opened by pressure of washing water pumped by the washing pump 150. In some implementations, the check valve 175 may be a solenoid valve that is opened and closed in accordance with an electronic signal.

The check valve 175 is formed to allow washing water to flow from the washing pump 150 to the sump 100 even in a closed state while the drain pump 25 operates.

Some of steam generated in the washing pump 150 by the heater 140 flows to the steam nozzle 195 through the steam hose 190, and is then discharged from a front lower end of the tub 12 in an upwardly inclined manner.

Other steam generated in the washing pump 150 by the heater 140 flows to the sump 100 through the water collection passage 170 and then is discharged upwardly from the bottom 12*b* of the tub 12 through the communication hole 12*c*. The steam flowing to the sump 100 through the water collection passage 170 sterilizes the filter 26 while passing through the filter 26.

Other steam generated in the washing pump 150 by the heater 140 flows to at least one of the plurality of spray arms 13, 14, and 15 through the washing water supply passage 180, the switch valve 130, and at least one of the plurality of spray arm connection passages 18, 19, and 21, and is then discharged into the tub 12. In this embodiment, when steam is generated, the switch valve 130 connects the washing pump 150 to the top spray arm 15 disposed highest among the plurality of spray arms 13, 14, and 15, such that the top spray arm 15 discharges the steam downwardly from the top of the tub 12.

Figure 3:
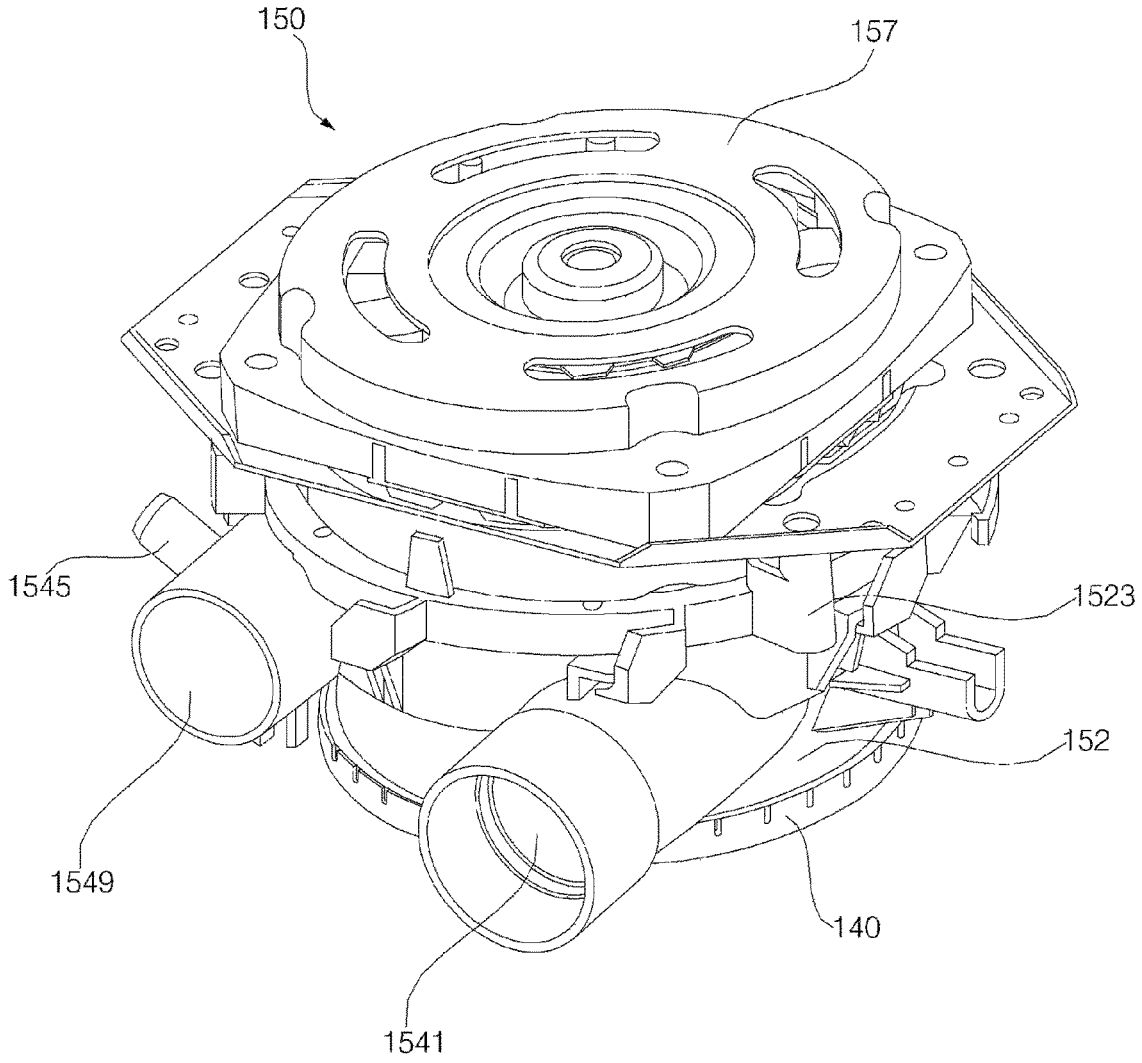
FIG. 3 is a perspective view of a washing pump and a heater according to an embodiment of the present invention
Figure 4:
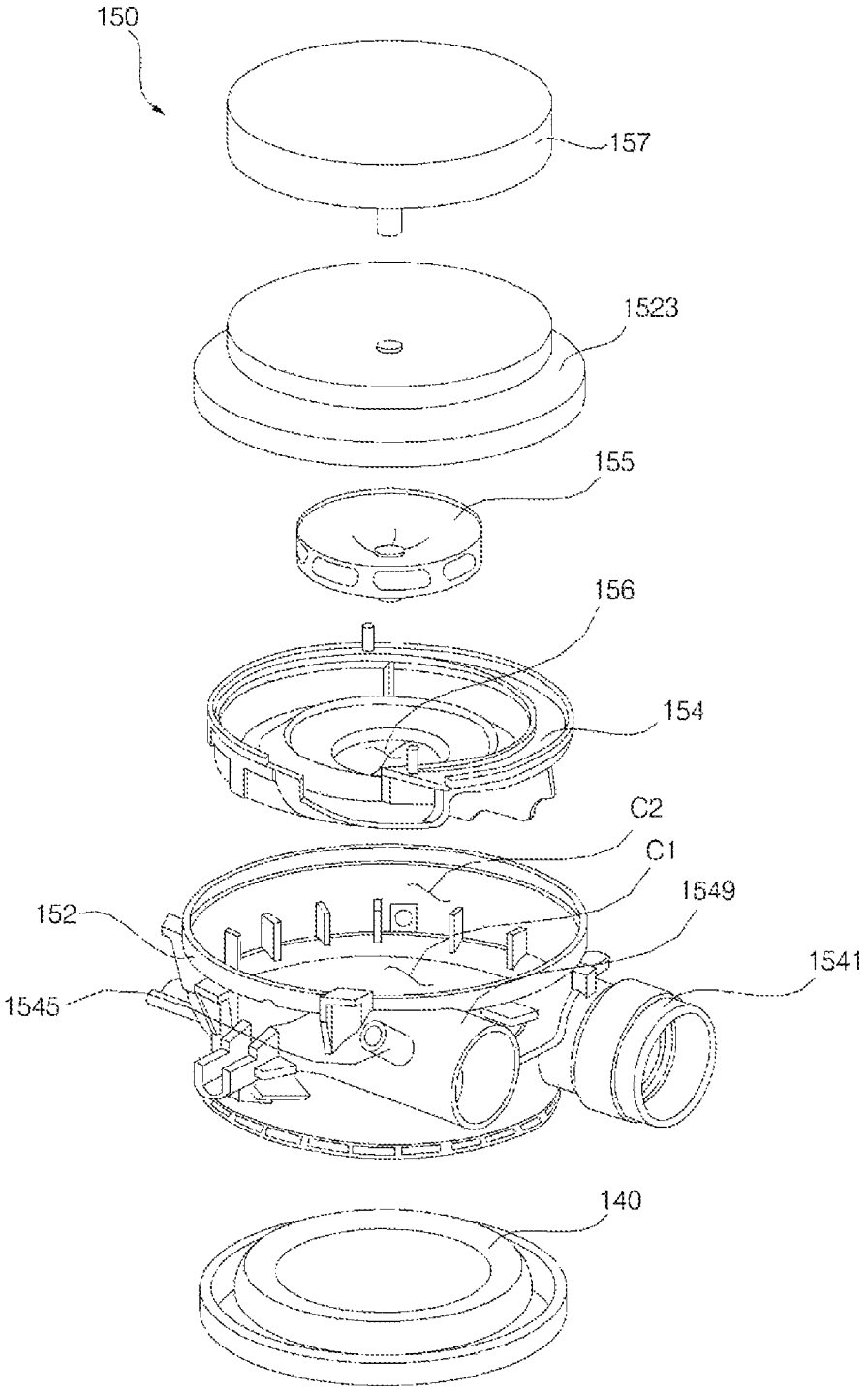
FIG. 4 is an exploded perspective view of a washing pump and a heater according to an embodiment of the present invention.
Figure 5:
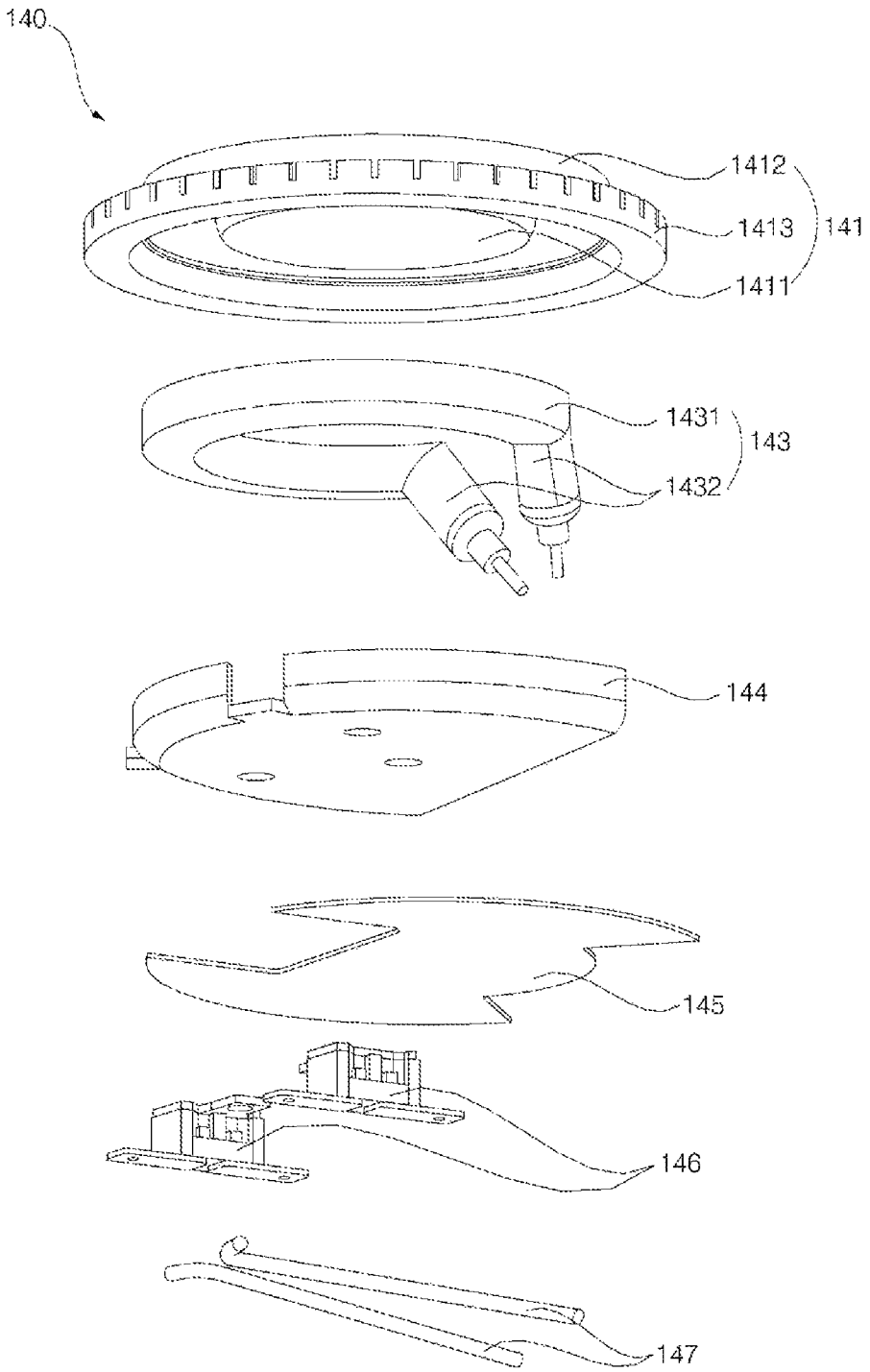
FIG. 5 is an exploded perspective view of a heater according to an embodiment of the present invention.
Figure 6:
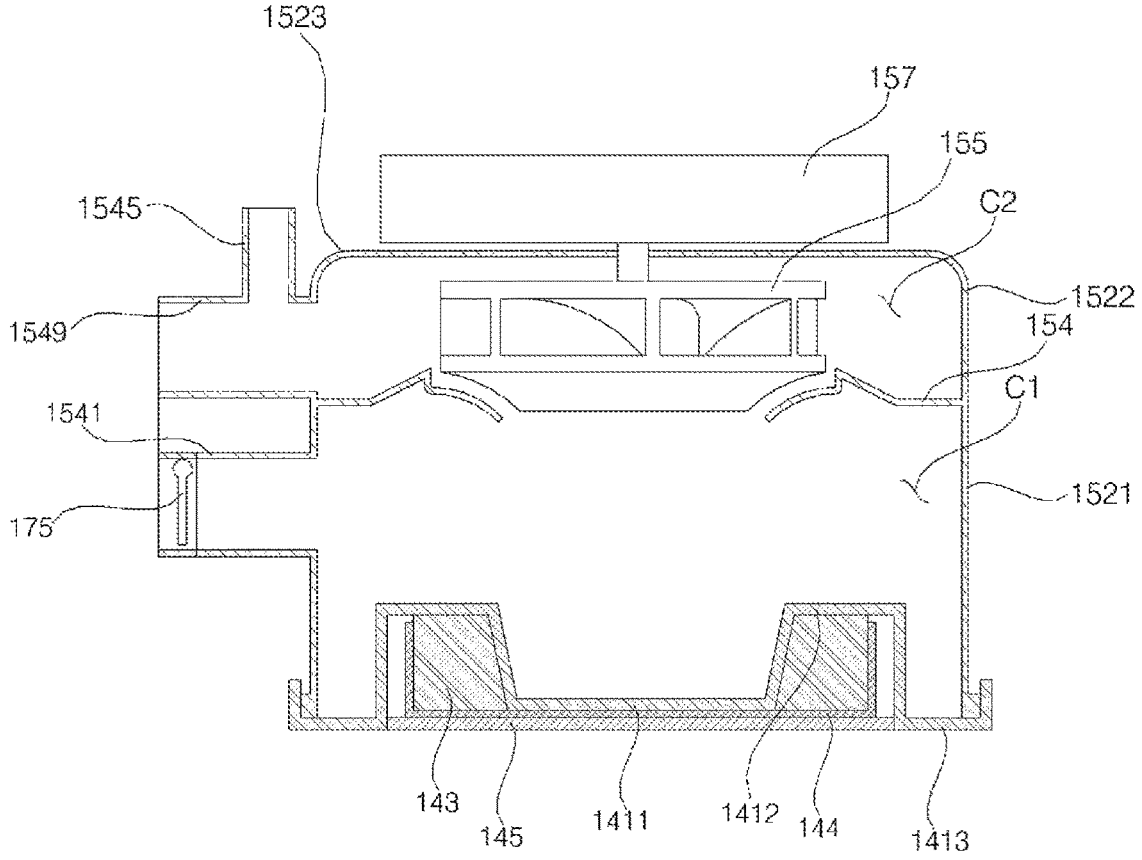
FIG. 6 is a schematic cross-sectional view of a washing pump according to an embodiment of the present invention.

FIG. 3 is a perspective view of a washing pump and a heater according to an embodiment of the present invention, and FIG. 4 is an exploded perspective view of a washing pump and a heater according to an embodiment of the present invention. FIG. 5 is an exploded perspective view of a heater according to an embodiment of the present invention, and FIG. 6 is a schematic cross-sectional view of a washing pump according to an embodiment of the present invention.

A washing pump 150 according to an embodiment of the present invention includes: a cylindrical housing 152 which is coupled to a sump 100; a washing water inflow pipe 1541 which is connected to the housing 152, and through which washing water flows into the housing 152 by rotation of an impeller 155; a washing water outflow pipe 1549 which is connected to the housing 152, and through which washing water flows out of the housing 152 by rotation of the impeller 155; the rotatable impeller 155 which is disposed inside the housing 152 to pump washing water flown into the washing water inflow pipe 1541 to the washing water outflow pipe 1549; a motor 157 which rotates the impeller 155; and a steam discharge pipe 1545 which is disposed in the washing water outflow pipe 1549 to discharge steam generated by the heater 140.

The housing 152 is formed in a cylindrical shape with a top surface and a bottom surface which are open. The housing 152 is coupled to the sump 100. A top of the housing 152 is coupled to a housing cover 1523, and a bottom of the housing 152 is coupled to the heater 140. The housing cover 1523 covers the top of the housing 152, and the motor 157 generating a rotational force to rotate the impeller 155 is provided in the housing cover 1523.

A partition wall 154 is disposed inside the housing 152. The partition wall 154 is disposed at the middle end of the housing 152 to vertically divide an inner space. The partition wall 154 is disposed under the impeller 155. The partition wall 154 is disposed over the washing water inflow pipe 1541 and under the washing water outflow pipe 1549. The partition wall 154 forms a lower chamber C1 and an upper chamber C2 in the housing 152. The lower chamber C1 is a space where negative pressure is generated by rotation of the impeller 155, and the upper chamber C2 is a space where the impeller 155 is received and positive pressure is generated by rotation of the impeller 155. The lower chamber C1 is connected to the sump 100 through a water collection passage 170 and the washing water inflow pipe 1541. The upper chamber C2 is connected to a switch valve 130 through the washing water outflow pipe 1549 and a washing water supply passage 180. In addition, the upper chamber C2 is connected to the steam nozzle 195 through the steam discharge pipe 1545 and a steam hose 190.

The partition wall 154 divides the washing pump 150 into a pump lower portion 1521, into which washing water enters by rotation of the impeller 155, and a pump upper portion 1522 from which washing water is discharged by rotation of the impeller 155. Washing water enters into the pump lower portion 1521, and the lower chamber C1 is formed in the pump lower portion 1521. The pump lower portion 1521 includes a lower portion of the housing 152 and the washing water inflow pipe 1541. The pump lower portion 1521 may further include a heater cover 151 of the heater 140.

The pump upper portion 1522 discharges washing water or steam to an outside, and the upper chamber C2 is formed in the pump upper portion 1522. The pump upper portion 1522 includes an upper portion of the housing 152, the washing water outflow pipe 1549, the steam discharge pipe 1545, and the housing cover 1523. The impeller 155 is disposed inside the pump upper portion 1522, and the motor 157 is disposed over the pump upper portion 1522.

A partition wall hole 156 through which the lower chamber C1 and the upper chamber C2 communicates each other is formed in the partition wall 154. A surface of the partition wall 154 facing the upper chamber C2 is in a volute form to guide washing water, which has entered into the upper chamber C2 from the lower chamber C1 through the partition wall 156, to the washing water outflow pipe 1549. A guider (not shown) protruding downwardly is formed in a bottom surface of the partition wall 154 facing the lower chamber C1. The guider of the partition wall 154 guides washing water, which has entered into the lower chamber C1 through the washing water inflow pipe 1541, to the partition wall hole 156. The guider of the partition wall 154 allows washing water in the lower chamber C1 to be uniformly heated by the heater 140.

The impeller 155 rotates by the motor 157 to cause washing water in the housing 152 to flow such that the washing water is pumped to an outside of the housing 152. The impeller 155 is rotatably disposed inside the upper chamber C2. The impeller 155 pumps washing water, which has entered from the lower chamber C1 into the upper chamber C2 through the partition wall 156, to the washing water outflow pipe 1549.

The washing water inflow pipe 1541 is connected to one side of the lower chamber C1 of the housing 152. The washing water inflow pipe 1541 is connected to the water collection passage 170 such that washing water in the sump 100 flows into the lower chamber C1. The washing water inflow pipe 1541 is disposed to protrude outward from a lower side wall of the housing 152. The washing water inflow pipe 1541 is disposed in a horizontal direction so that a washing water inflow direction is horizontal.

The washing water outflow pipe 1549 is connected to the upper chamber C2 of the housing 152. The washing water outflow pipe 1549 is connected to the washing water supply passage 180 such that washing water in the upper chamber C2 outflows to the washing water supply passage 180. The washing water outflow pipe 1549 is disposed to protrude outward from an upper side wall of the housing 152. The washing water outflow pipe 1549 is disposed in a horizontal direction, so that a washing water outflow direction is horizontal. The washing water outflow pipe 1549 is disposed higher than the washing water inflow pipe 1541. A washing water outflow direction of the washing water outflow pipe 1549 is opposite to a washing water inflow direction of the washing water inflow pipe 1541.

The steam discharge pipe 1545 is connected to one side of the upper chamber C2 of the housing 152. The steam discharge pipe 1545 is disposed over the partition wall 154. The steam discharge pipe 1545 may be disposed at any of various positions in the housing 152 so as to connect the upper chamber C2 of the housing 152 and the steam hose 190, and, in this embodiment, the steam discharge pipe 1545 is disposed in the washing water outflow pipe 1549. The steam discharge pipe 1545 is disposed to be inclined so that a steam discharge direction is inclined upwardly. The steam discharge direction of the steam discharge pipe 1545 is vertical to a washing water outflow direction of the washing water outflow pipe 1549.

As the steam discharge pipe 1545 is connected to the steam hose 190, the steam discharge pipe 1545 discharges steam, generated by the heater 140 in the housing 152, to the steam hose 190. The steam hose 190 is connected between the impeller 155 and the switch valve 130 in the circulation passage through the steam discharge pipe 1545, and it is desirable that the steam hose 190 is connected to the upper chamber C2.

The heater 140 is disposed between the sump 100 and the impeller 155 in the circulation passage, and it is desirable that the heater 140 is connected between the water collection passage 170 and the impeller 155. It is desirable that the heater 140 is coupled to one side of the housing 152 so as to be coupled to the lower chamber C1. The heater 140 is connected to the bottom of the housing 152 to form a bottom surface of the housing 152. When the impeller 155 rotates, the heater 140 heats washing water that is flowing in the housing 152. Then, when the impeller 155 stops rotating, the heater 140 generates steam by heating washing water in the housing 152. The heater 140 is disposed under the washing water inflow pipe 1541. The heater 140 is disposed under the partition wall 154. A part of the heater 140 is disposed inside the housing 152.

The check valve 175 is coupled to the washing water inflow pipe 1541. An upper end of the check valve 175 is coupled to an upper end of the washing water inflow pipe 1541. The check valve 175 is opened when the impeller 155 rotates, and the check valve 175 is closed when the impeller 155 stops rotating. The check valve 175 is opened when the motor 157 operates, and the check valve 175 is closed when the motor 157 stops operating.

The check valve 175 is formed to allow washing water flows from the washing pump 150 to the sump 100 when the discharge pump 25 operates. When the check valve 175 is closed, a part of a lower portion of the washing water inflow pipe 1541 is opened. The check valve 175 covers 50% to 90%, preferably 70%, of a cross-sectional area of the washing water inflow pipe 1541 when the check valve 175 is closed. The check valve 175 is closed while the heater 140 generates steam, but the part of the lower portion of the washing water inflow pipe 1541 is opened, and thus, the steam generated in the housing 152 flows out to the sump 100 through the washing water inflow pipe 1541.

While the heater 140 generates steam, the check valve 175 is closed not to allow washing water or the steam to flow from the washing pump 150 to the sump 100. When the drain pump 25 and the motor 157 stop (when they stop operating), the check valve 175 stores washing water in the housing 152. The heater 140 generates steam by heating the washing water, stored in the housing 152, by the check valve 175.

The heater 140 according to an embodiment of the present invention includes: a heater cover 141 which forms a bottom surface of the housing 152; a heating element 143 which is disposed in contact with a lower side of the heater cover 141 to heat the heater cover 141; a heater plate 144 which is disposed in contact with a lower side of the heating element 143 and the heater cover 141 to transfer heat of the heating element 143 to the heater cover 141; a thermostat 146 which supplies power to the heating element 143 and adjusts temperature of the heating element 143; a wire 147 which electronically connects the heating element 143 and the thermostat 143 with each other; and a heater shield 145 which is disposed under the heater plate 144 to cover a part of the heater plate 144.

The heater cover 141 is coupled to the bottom of the housing 152 to form a bottom surface of the housing 152 of the washing pump 150. A top surface of the heater cover 141 comes into contact with washing water. The heating element 143 and the heater plate 144 are bonded to the bottom of the heater cover 141. The heater cover 141 is heated by the heating element 143 and the heater plate 144 to thereby heat washing water.

A circumference of the heater cover 141 is formed in a circular shape, and has a plurality of vertical bends on a concentric circle. A part of the heater cover 141 is in a ring shape protruding upwardly (toward the partition wall 154 of the washing pump 150). A part of the heater cover 141 protrudes inward of the housing 152 to form a ring-shaped space where a part of the heating element 143 is received. A part of the heater cover 141 is disposed between washing water received in the housing 152 and the heating element 143. Accordingly, the heating element 143 is not brought into contact with the washing water received in the housing 152.

The heater cover 141 includes a cover base 1411 in a disk shape, a cover holder 1412 protruding upwardly from a circumference of the cover base 1411, and a cover rim 1413 formed on a circumference of the cover holder 1412 to be coupled to the housing 152.

The cover base 1411 is in a disk shape to form a central portion of the heater cover 141. A central portion of the heater plate 144 is bonded to a bottom of the cover base 1411. The cover base 1411 and the central portion of the heater plate 144 are bonded by brazing.

The cover holder 1412 is formed in a ring shape protruding upward. The cover holder 1412 forms a ring-shaped space where a part of the heating element 143 is received. A main heating element 1431 of the heating element 143, which will be described later on, is received in the ring-shaped space of the cover holder 1412. A part of the heating element 143 is bonded to the inside of the cover holder 1412. The cover holder 1412 and the part of the heating element 143 are bonded by brazing.

The cover holder 1412 is formed by an open curve such that a vertical cross-section in a radial direction from the center of the cover holder 1412 has an open bottom. At least a part of the cover holder 1412 is formed to correspond to a shape of a part of the heating element 143, the part of the heating element 143 being received in the ring-shaped space of the cover holder 1412. The cover holder 1412 directly contact the part of the heating element 143, while receiving the part of the heating element 143. An internal surface of an external circumference of the cover holder 1412 is spaced apart from a partial external circumferential surface of the heating element 143, the part of the heating element 1413 being received in the ring-shaped space of the cover holder 1412.

The cover rim 1413 is in a rim shape. The cover rim 1413 is formed to surround a circumference of the lower end of the housing 152. A peripheral edge of the cover rim 1413 protrude upwardly to be coupled to the housing 152. Since the cover rim 1413 is not brought into contact with the heater plate 144 and the heating element 143, the cover rim 1413 is heated to a relatively lower temperature.

The heating element 143 generates heat by being supplied with power from the thermostat 146 through the wire 147. The heat element 143 heats the heater cover 141 and the heater plate 144. The heater cover 141 is bonded to a top of the heating element 143 by brazing, and the heater plate 144 is bonded to a bottom of the heat element 143 by brazing.

A partial external circumference of the heating element 143 is spaced apart from a part of the heater cover 141, which forms a ring-shaped space. The part of the heating element 143 is received within the ring-shaped space formed in the heater cover 141 and disposed inside the housing 152. Since the heating element 143 is disposed under the heater cover 141 which forms the bottom surface of the housing 152, the heating element 143 is disposed outside the washing pump 150 while a part of the heating element 143 is disposed inside the housing 152.

The heating element 143 includes the main heating element 1431 which generates heat and which is in an arc shape, and a heating terminal 1432 which supplies power to the heating main body 1431.

The main heating element 1431 is formed in a large arc shape with a central angle of 180° or greater. The main heating element 1431 is received within the cover holder 1412. A top surface and an internal circumferential surface of the main heating element 1431 are brought into contact with the heater cover 141 and heat the heater cover 141. A bottom surface and an external circumferential surface of the main heating element 1431 are brought into contact with the heater plate 144 and heat the heater plate 144. The main heating element 1431 is disposed higher than the bottom of the housing 152.

The heating terminal 1432 is supplied with power from the thermostat 146 through the wire 147 and transfers the power to the main heating element 1431. The heating terminal 1432 is provided as a plurality of heating terminals at both ends of the main heating element 1431. A plurality of heating terminals 1431 extends from the both ends of the main heating element 1431 in a downwardly inclined manner. That is, the plurality of heating terminal 1432 protrudes downwardly from a plane that is formed by a bottom of the main heating element 1431.

The heater plate 144 is heated by the heating element 143 to thereby heat the cover base 1411 of the heater cover 141. The heater plate 144 uniformly distributes heat of the heating element 143 to thereby uniformly heat the heater cover 141. The heater plate 144 is formed in a bowl shape. An internal circumferential surface of the heater plate 144 is brought into contact with the heating element 143, but an external circumferential surface of the heater plate 144 is spaced apart from the heater cover 141. The heater shield 145 is disposed under the heater plate 144.

Figure 7:
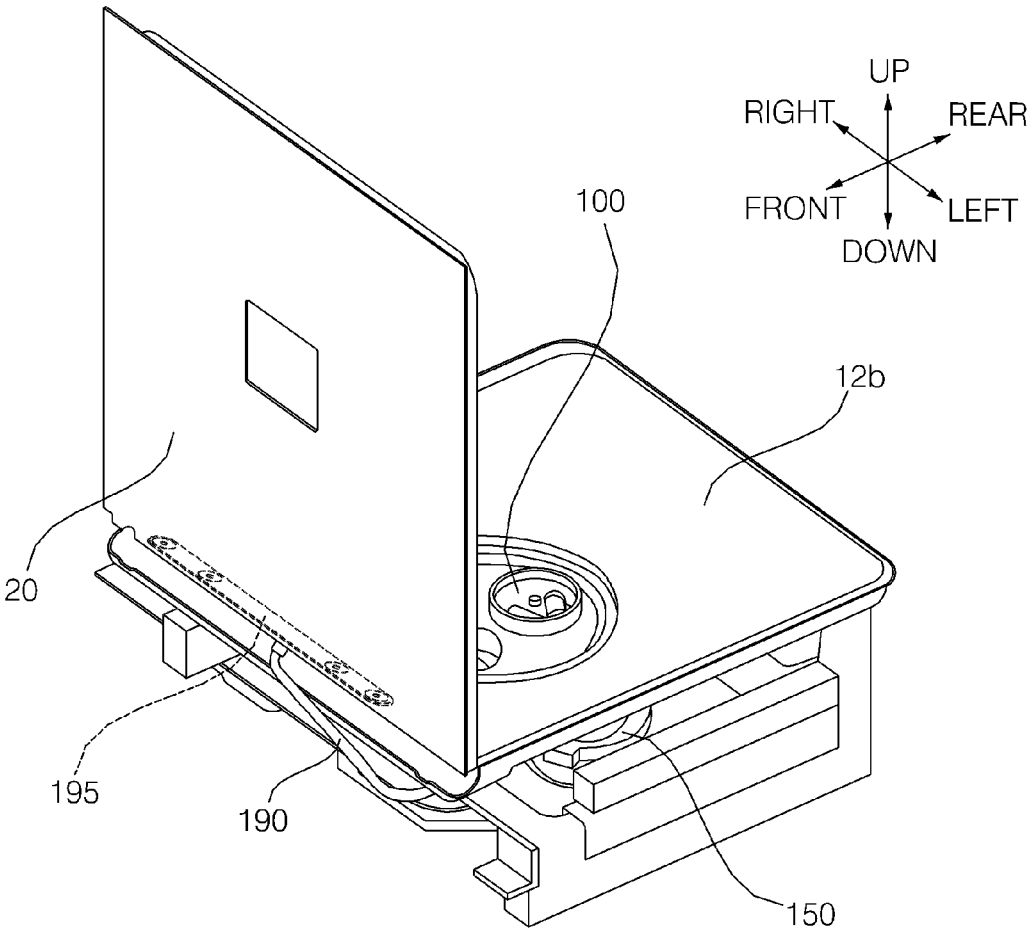
FIG. 7 is a perspective view of a part of a dishwasher according to an embodiment of the present invention.
Figure 8:
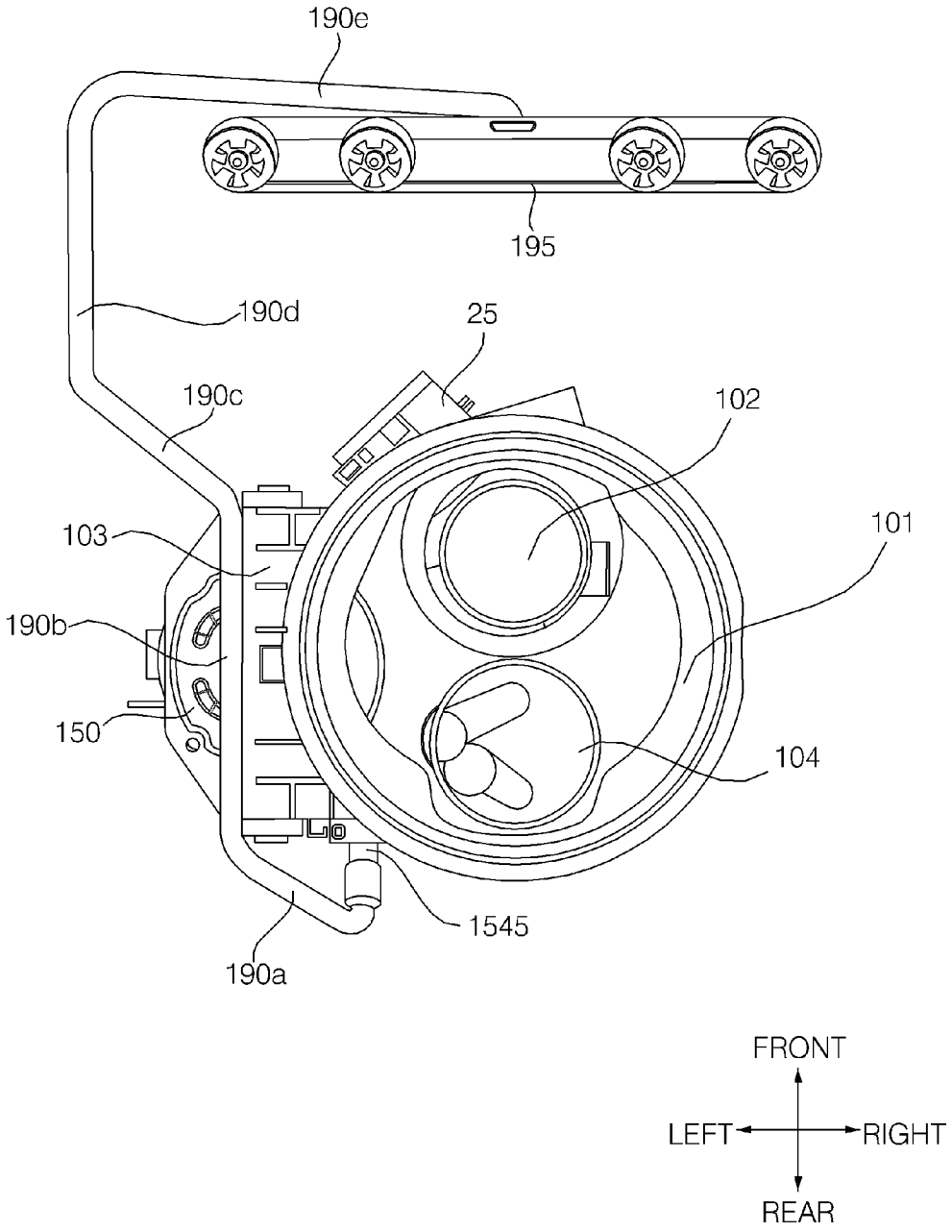
FIG. 8 is a plan view of a part of a dishwasher according to an embodiment of the present invention.
Figure 9:
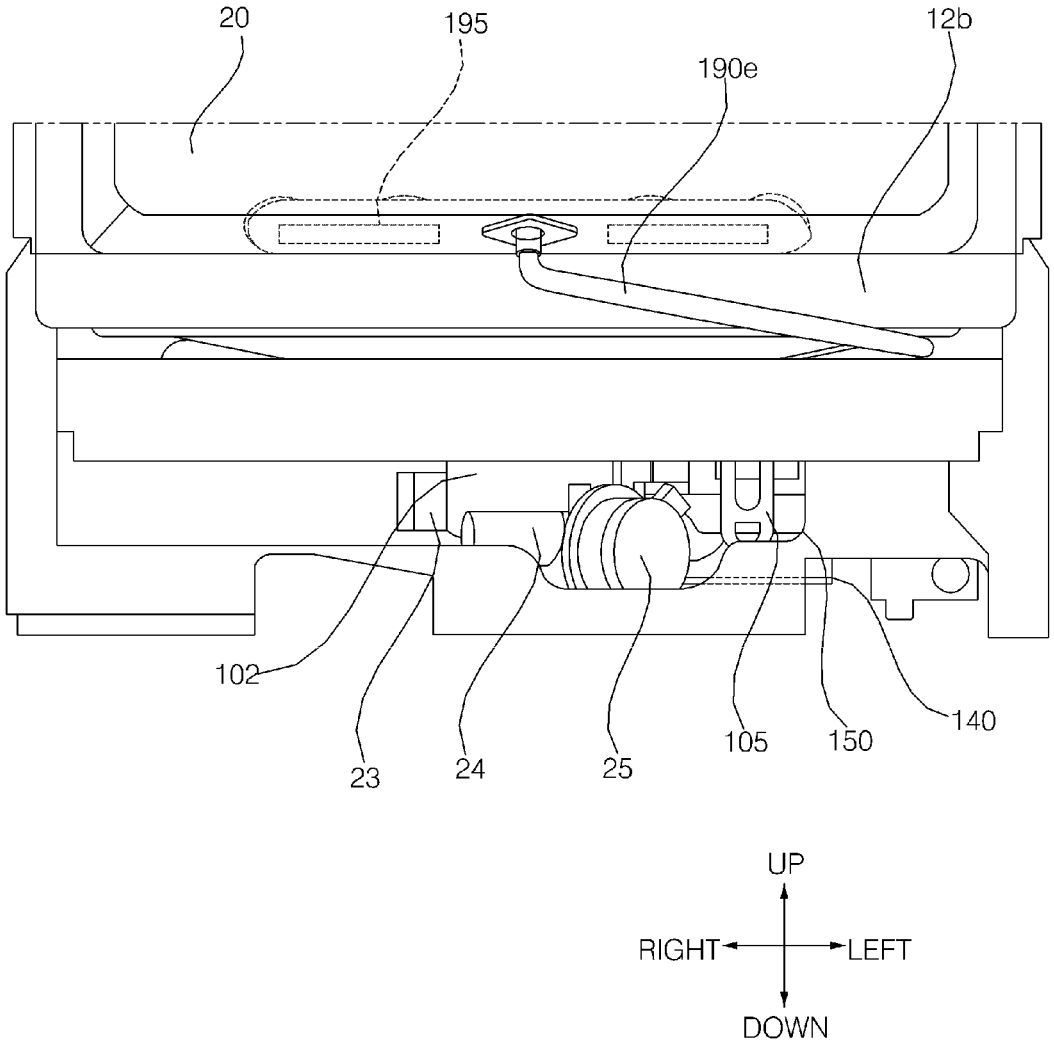
FIG. 9 is a front view of a part of a dishwasher according to an embodiment of the present invention.
Figure 10:
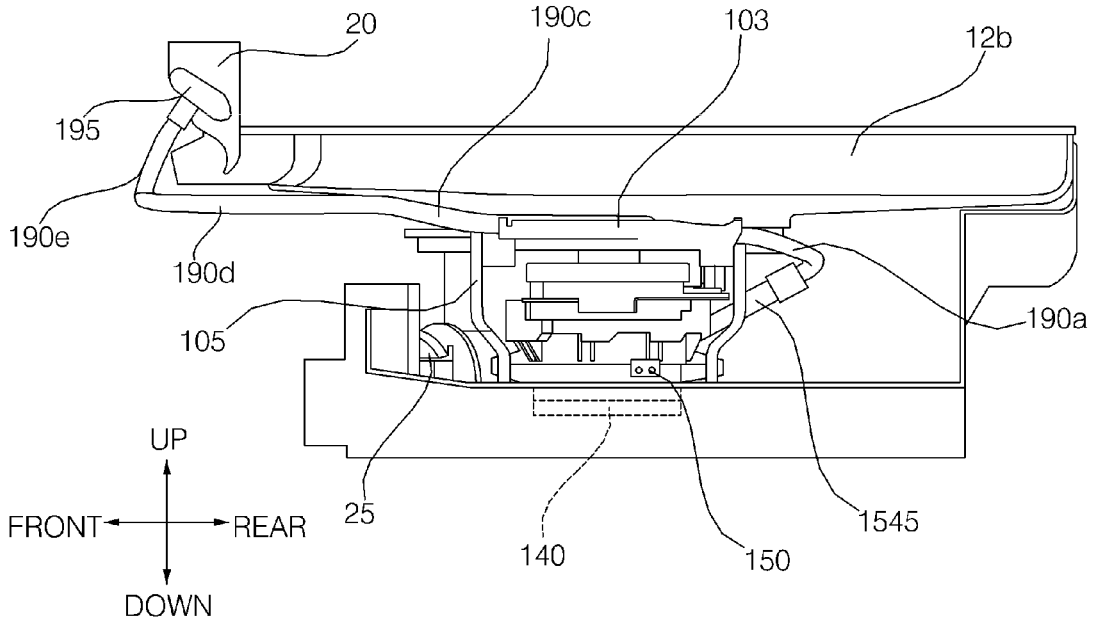
FIG. 10 is a left-side view of a part of a dishwasher according to an embodiment of the present invention.
Figure 11:
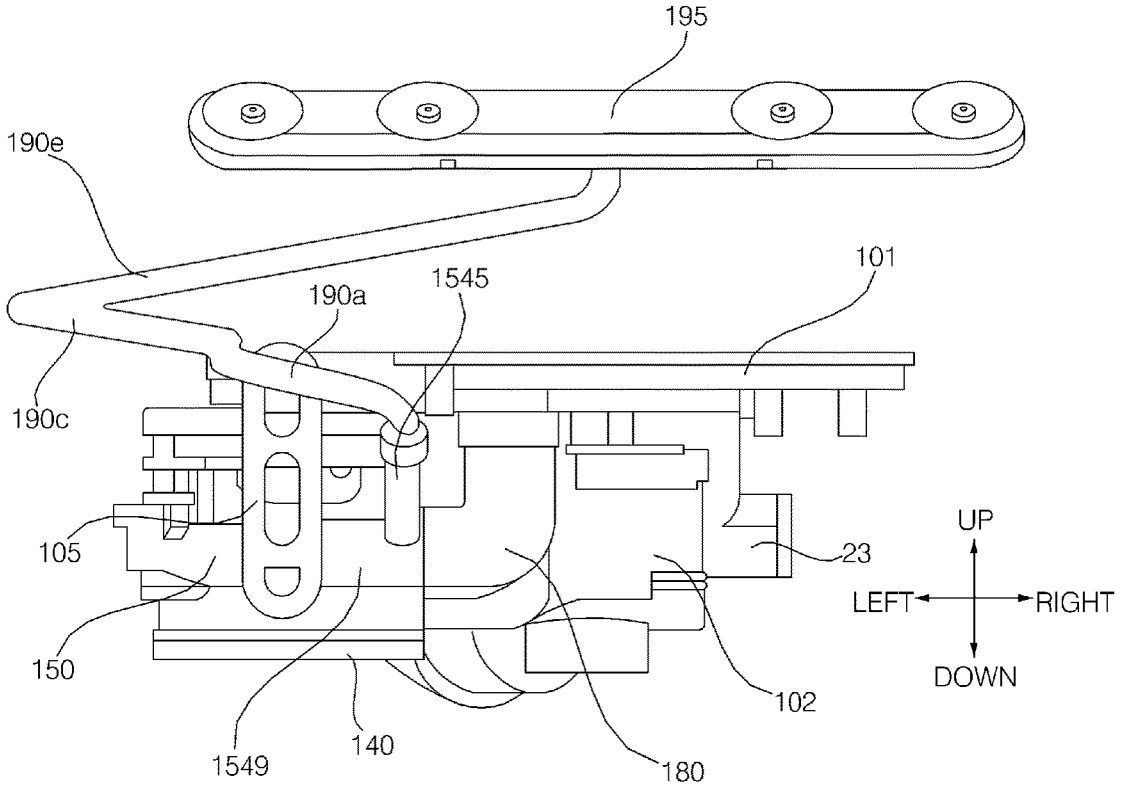
FIG. 11 is a rear view of a part of a dishwasher according to an embodiment of the present invention.

FIG. 7 is a perspective view of a part of a dishwasher according to an embodiment of the present invention, FIG. 8 is a plan view of a part of a dishwasher according to an embodiment of the present invention, FIG. 9 is a front view of a part of a dishwasher according to an embodiment of the present invention, FIG. 10 is a left-side view of a part of a dishwasher according to an embodiment of the present invention, and FIG. 11 is a rear view of a part of a dishwasher according to an embodiment of the present invention.

Hereinafter, a direction in which the door 20 is arranged with reference to the center of the dishwasher 1 is a forward direction, and an opposite direction to the forward direction is a rearward direction. In addition, a direction vertical to the forward-rearward direction on a horizontal plane is a left-right direction (a lateral direction), and a direction in which the washing pump 150 is disposed with reference to the center of the dishwasher 1 is a left lateral direction, and an opposite direction to the left lateral direction is a right lateral direction.

The sump 100 according to an embodiment of the present invention includes: a sump body 101 coupled to a bottom 12*b* of the tub 12; a water collection unit 102 in which washing water is collected; a steam hose supporter 103 extending in a horizontal direction from the sump body 101 and supporting the steam hose 190; a valve coupling portion 104 in which the switch valve 130 is disposed; and a washing pump connection member 105 connecting the steam hose supporter 103 and the washing pump 150.

The sump body 101 is disposed under a central portion of the bottom 12*b* of the tub 12 and coupled to the tub 12. The sump body 101 is roughly in a disk shape. A slope for guiding washing water to the water collection unit 102 may be formed on a top surface of the sump body 101.

The water collection unit 102 is formed in a cylindrical shape to store collected washing water. The water collection unit 102 is disposed under a communication hole 12C of the tub 12 to correspond to the communication hole 12*c*. The water collection unit 102 receives a part of a filter 26. The water supply passage 23 is connected to the water collection unit 102 such that washing water supplied from an external water supply source enters into the water collection unit 102. The water collection unit 102 includes a drain pump 25 mounted therein and is connected to the drain passage 24 such that washing water in the water collection unit 102 flows out of the water collection unit 102 through the drain passage 24. The water collection unit 102 is connected to the water collection passage 170 such that washing water in the water collection unit 102 flows out of the water collection unit 102 through the water collection passage 170.

In the valve coupling portion 104, the switch valve 130 is provided. The valve coupling portion 104 may be a part of the switch valve 130. The valve coupling portion 104 is roughly in a circular shape. A supply hole 104*a* communicating with the washing water supply passage 180 is formed in the valve coupling portion 104.

The steam hose supporter 103 extends in a horizontal direction from a side of the sump body 101 to thereby support the steam hose 190. A part of the steam hose 190 is arranged on a top surface of the steam hose supporter 103. The steam hose supporter 103 is connected to the washing pump connection member 105 to support the washing pump 150. The steam hose supporter 103 is disposed higher than an upper end of the steam discharge pipe 1545 of the washing pump 150 and lower than a lower end of the steam nozzle 195. The steam hose supporter 103 is disposed to cover at least a part of a top surface of the washing pump 150, especially at least a part of a top surface of the motor 157 of the washing pump 150.

The washing pump connection member 105 fixes the washing pump 150 to the sump 100. The washing pump connection member 105 may be provided as a plurality of washing pump connection members 105. An upper end of the washing pump connection member 105 is connected to the steam hose supporter 103, and a lower end of the washing pump connection member 105 is connected to the housing 152 of the washing pump 150.

In this embodiment, the water collection unit 102 and the valve coupling portion 104 are arranged in the sump body 101 in the forward-rearward direction. The water collection unit 102 is disposed in front of the valve coupling portion 104. The washing pump 150 is disposed on one lateral side of the sump 100. In this embodiment, the washing pump 150 is disposed on the left side of the sump 100. That is, the washing pump 150 is disposed on the left side of the water collection unit 102 and the valve coupling portion 104.

The washing pump 150 is disposed under the bottom 12*b* of the tub 12. The washing water inflow pipe 1541 and the washing water outflow pipe 1549 of the washing pump 150 are disposed to face the sump 100. The washing water inflow pipe 1541 is disposed to face the water collection unit 102, and the washing water outflow pipe 1549 is disposed to face the valve coupling portion 104. The washing water inflow pipe 1541 is disposed such that washing water flows in from a left direction, and the washing water outflow pipe 1549 is disposed such that washing water flows out in a right direction. The steam discharge pipe 1545 of the washing pump 150 is disposed such that steam is discharged to be inclined upwardly and rearwardly.

The heater 140 is disposed under the bottom 12*b* of the tub 12. The heater 140 is disposed under the washing pump 150. The heater 140 is disposed on one side of the sump 100. In this embodiment, the heater 140 is disposed on the left side of the sump 100. That is, the heater 140 is disposed on the left side of the water collection unit 102 and the valve coupling portion 104.

The steam hose 190 is disposed such that one end thereof is disposed on one side of the sump 100 and the other end thereof is disposed in front of the sump 100. The steam horse 190 is connected between the impeller 155 and the switch valve 130 in the circulation passage. In this embodiment, the steam hose 190 is connected to the upper chamber C2 of the washing pump 150 through the steam discharge pipe 1545 of the washing pump 150.

One end of the steam hose 190 is connected to the washing pump 150 disposed under the bottom 12*b* of the tub 12, and the steam hose 190 extends under the bottom 12*b* of the tub such that the other end of the steam hose 190 is connected to the steam nozzle 195 disposed at the door 20. The steam hose 190 is not disposed over the bottom 12*b* of the tub 12.

The steam hose 190 is disposed to be inclined upwardly from the washing pump 150 with reference to a steam flow direction, or disposed to face a horizontal direction. That is, the steam hose 190 is disposed not to have a portion that is inclined downwardly with reference to the steam flow direction.

The steam hose 190 includes: a first steam hose portion 190*a* of which one end is connected to the steam discharge pipe 1545 of the washing pump 150, and which is disposed to be inclined upwardly with reference to a steam flow direction; a second steam hose portion 190*b* which is bent from the first steam hose portion 190*a* to be horizontally disposed forward with reference to the steam flow direction, and which is disposed on the top surface of the steam hose supporter 103; a third steam hose portion 190*c* which is bent from the second steam hose portion 190*b* to be inclined forwardly and laterally (the left direction in this embodiment) with reference to the steam flow direction; a fourth steam hose portion 190*d* which is bent from the third steam hose portion 190*c* to be horizontally disposed forward with reference to the steam flow direction; and a fifth steam hose portion 190*e* which is bent from the fourth steam hose portion 190*d* to be inclined upwardly with reference to the steam flow direction and connected to the steam nozzle 195.

The first steam hose portion 190*a* is inclined toward the steam hose supporter 103 from one end which is connected to the steam discharge pipe 1545. The second steam hose portion 190*b* is supported by the steam hose supporter 103 to be horizontally disposed forward along an edge of one lateral side (the left side in this embodiment) of the sump 100. The third steam hose portion 190*c* is disposed upwardly while inclined laterally toward an edge of one lateral side (the left side in this embodiment) of the bottom 12*b* of the tub 12. The fourth steam hose portion 190*d* is horizontally disposed below along an edge of one lateral side (the left side in this embodiment) of the bottom 12*b* of the tub 12. The fifth steam hose portion 190*e* is disposed in front of the bottom 12*b* of the tub 12 to be inclined toward the steam nozzle 195 disposed at a lower end of the door 20. The fifth steam hose portion 190*e* is disposed to cross the front of the bottom 12*b* of the tub 12.

Although the exemplary embodiments have been illustrated and described, embodiments are not limited to the above-described particular embodiments, various modifications are possible by those skilled in the art without departing from the scope and spirit as disclosed in the accompanying claims and these modifications should not be understood separately from the scope and spirit.

What is claimed is:

1. A dishwasher comprising:

a tub that defines a washing space configured to receive one or more objects;

a door located at a front surface of the tub and configured to open and close at least a portion of the washing space;

a sump located vertically below the tub and configured to store washing water;

a spray arm configured to spray washing water received from the sump to the tub;

a circulation passage that connects the sump to the spray arm;

a heater configured to heat washing water in the circulation passage;

a steam nozzle configured to discharge steam generated by the heater to the tub; and a steam passage that is connected to the steam nozzle and that allows steam generated by the heater to flow to the steam nozzle, wherein at least one of the spray arm and the sump is configured to discharge steam generated by the heater to the tub through the circulation passage, and wherein the steam nozzle is located at a lower end of the door and configured to discharge steam in a direction inclined upward with respect to a bottom of the tub.

2. The dishwasher of claim 1, wherein the steam passage is branched from the circulation passage.

3. The dishwasher of claim 1, wherein a part of the steam passage is located vertically below the bottom of the tub and connected to the steam nozzle.

4. The dishwasher of claim 1, wherein a part of the steam passage extends to the door along a lateral side of a top of the sump.

5. The dishwasher of claim 1, wherein a part of the steam passage extends to the door along a lateral side of the bottom of the tub.

6. The dishwasher of claim 1, wherein a part of the steam passage extends from an end of a lateral side of the bottom of the tub to the door in the direction inclined upward with respect to the bottom of the tub.

7. The dishwasher of claim 1, wherein a part of the steam passage extends from the circulation passage to a top of the sump in a direction inclined upward with respect to a bottom of the sump.

8. The dishwasher of claim 1, wherein the heater is configured to generate steam at a space defined vertically below the bottom of the tub.

9. The dishwasher of claim 1, wherein the steam passage extends to a portion of the circulation passage located vertically below the bottom of the tub.

10. The dishwasher of claim 1, further comprising a washing pump that defines at least a portion of the circulation passage and that is configured to pump washing water from the sump to the spray arm, wherein the steam passage is connected to the washing pump.

11. The dishwasher of claim 10, wherein a part of the heater is located inside of the washing pump.

12. The dishwasher of claim 10, wherein the washing pump comprises:

an impeller configured to rotate about an axis and cause flow of washing water;

a pump upper portion configured to receive the impeller and discharge washing water to the spray arm; and a pump lower portion configured to receive washing water from the sump, and wherein the steam passage is connected to the pump upper portion.

13. The dishwasher of claim 1, wherein the spray arm comprises a plurality of spray arms, wherein the dishwasher further comprises:

an impeller that is located in the circulation passage and that is configured to cause flow of washing water based on rotation of the impeller; and a switch valve configured to selectively connect the sump to at least one of the plurality of spray arms, and wherein the steam passage is connected to the circulation passage between the impeller and the switch valve.

14. The dishwasher of claim 13, wherein the plurality of spray arms are arranged at one or more vertical heights with respect to the bottom of the tub, wherein the switch valve is configured to, based on the heater generating steam, connect the sump to an uppermost spray arm among the plurality of spray arms, and wherein the uppermost spray arm among the plurality of spray arms is configured to discharge steam downward from a top of the tub.

15. The dishwasher of claim 1, further comprising a filter that is located inside of the sump, that is configured to restrict passage of foreign substances, and that allows passage of steam discharged from the sump through the circulation passage.

16. The dishwasher of claim 1, wherein the sump is configured to discharge steam in an upward direction from the bottom of the tub.

17. The dishwasher of claim 1, wherein the circulation passage allows flow of at least one of washing water or steam from the sump to the tub.

18. The dishwasher of claim 1, wherein the steam nozzle comprises a plurality of nozzle heads spaced apart from each other and arranged at the lower end of the door in a width direction of the door, and wherein the steam passage is connected to a point between the plurality of nozzle heads.

19. The dishwasher of claim 10, further comprising a steam hose that connects the washing pump to the spray arm and that defines at least a portion of the steam passage.

* * * * *